US011447290B2

(12) United States Patent
Hundeloh et al.

(10) Patent No.: US 11,447,290 B2
(45) Date of Patent: Sep. 20, 2022

(54) LID FOR AN ALUMINUM BEVERAGE CAN

(71) Applicant: BALL BEVERAGE PACKAGING EUROPE LIMITED, Bedfordshire (GB)

(72) Inventors: Thomas Hundeloh, Bad Marienberg (DE); Olaf Joeressen, Meerbusch (DE); Pim Van Dam, EC Epe (NL); Ralf Wersuhn, Bornheim (DE)

(73) Assignee: BALL BEVERAGE PACKAGING EUROPE LIMITED, Bedfordshire (GB)

( * ) Notice: Subject to any disclaimer, the term of this patent is extended or adjusted under 35 U.S.C. 154(b) by 321 days.

(21) Appl. No.: 16/305,661

(22) PCT Filed: May 17, 2017

(86) PCT No.: PCT/EP2017/061863
§ 371 (c)(1),
(2) Date: Nov. 29, 2018

(87) PCT Pub. No.: WO2017/207277
PCT Pub. Date: Dec. 7, 2017

(65) Prior Publication Data

US 2020/0140140 A1 May 7, 2020

(30) Foreign Application Priority Data

May 31, 2016 (DE) ..... 10 2016 110 064.1

(51) Int. Cl.
*B65D 17/34* (2006.01)
*B65D 17/28* (2006.01)

(52) U.S. Cl.
CPC .. *B65D 17/4012* (2018.01); *B65D 2517/0014* (2013.01)

(58) Field of Classification Search
CPC .... B65D 2517/0089; B65D 2517/0014; B65D 2517/0016; B65D 2517/0071; B65D 2517/0073
See application file for complete search history.

(56) References Cited

U.S. PATENT DOCUMENTS 3,341,055 A * 9/1967 Radford ..... B65D 17/4012 220/273
3,877,606 A 4/1975 Silver
(Continued)

FOREIGN PATENT DOCUMENTS

AU 2009289732 3/2010
CN 2647756 10/2004
(Continued)

OTHER PUBLICATIONS

Decision to Grant for European Patent Application No. 17724028.0, dated May 14, 2020 33 pages.
(Continued)

*Primary Examiner* — Allan D Stevens
(74) *Attorney, Agent, or Firm* — Sheridan Ross P.C.

(57) ABSTRACT

A can lid (14) for an aluminum beverage can is disclosed and has a pull tab (38), a chuck wall (26) defining a plug diameter B, a countersink (28) and a central panel (30) having a panel radius (48). On the central panel, a score line (34) defining a tear panel (32) and a rivet (40) for connecting the pull-tab to the can lid are arranged. The lid has a lid plug diameter of between 45 to 49 mm, an outside diameter of between 52 to 55 mm, and a weight of less than 1.9 g. The central panel has a thickness of less than 0.19 mm. The rivet is arranged off-center on the central panel. The rivet is tilted, so that the rivet provides an axis of rotation of the pull tap that has an angle of between 2° and 4° with respect to an axis that is vertically orientated with respect to the central panel,
(Continued)

and/or at least one ramp-up bead (56) is arranged on either side of pull tab or on both sides of the pull tab.

19 Claims, 13 Drawing Sheets

(56) References Cited

U.S. PATENT DOCUMENTS

| | | | | |
|---|---|---|---|---|
| 3,990,603 | A | 11/1976 | Brochman | |
| 4,012,935 | A | 3/1977 | Holk, Jr. et al. | |
| 4,202,287 | A * | 5/1980 | Zundel | B65D 17/4012 29/524.1 |
| 4,994,009 | A | 2/1991 | McEldowney | |
| 5,224,618 | A | 7/1993 | Garbiso | |
| 5,248,053 | A | 9/1993 | Lundgren | |
| 5,911,794 | A * | 6/1999 | Nordhoff | B65D 17/4012 81/3.55 |
| 6,098,830 | A * | 8/2000 | Jamieson | B65D 17/4014 220/730 |
| 6,354,453 | B1 | 3/2002 | Chasteen | |
| 6,763,963 | B1 * | 7/2004 | Martin | B65D 17/4014 220/254.1 |
| 7,089,825 | B2 * | 8/2006 | Klosterman | B67B 7/403 81/3.35 |
| 7,594,585 | B1 * | 9/2009 | Fields | B65D 17/4012 220/269 |
| 7,975,884 | B2 | 7/2011 | Mathabel et al. | |
| 8,464,887 | B2 | 6/2013 | Cherian | |
| 9,033,174 | B2 | 5/2015 | Chasteen et al. | |
| 9,181,006 | B2 | 11/2015 | Neiner et al. | |
| 9,254,945 | B2 | 2/2016 | McClung et al. | |
| 2002/0108954 | A1 * | 8/2002 | Cho | B65D 17/4012 220/269 |
| 2002/0170913 | A1 | 11/2002 | Yamasaki et al. | |
| 2005/0252917 | A1 * | 11/2005 | Turner | B65D 17/34 220/269 |
| 2007/0108208 | A1 | 5/2007 | Dickie | |
| 2008/0099480 | A1 | 5/2008 | Chang | |
| 2012/0031056 | A1 | 2/2012 | Chasteen et al. | |
| 2014/0054332 | A1 | 2/2014 | McClung et al. | |
| 2014/0263328 | A1 | 9/2014 | Rayburn et al. | |
| 2015/0239607 | A1 | 8/2015 | Fields et al. | |
| 2015/0367984 | A1 | 12/2015 | Forrest et al. | |
| 2016/0031594 | A1 | 2/2016 | Ramsey et al. | |
| 2019/0092519 | A1 * | 3/2019 | Reiter | B65D 51/248 |

FOREIGN PATENT DOCUMENTS

| | | |
|---|---|---|
| CN | 2661596 | 12/2004 |
| CN | 101568474 | 10/2009 |
| CN | 105416765 | 3/2016 |
| CN | 104684813 | 9/2017 |
| CN | 107352119 | 11/2017 |
| DE | 102014211265 | 12/2015 |
| EP | 2612823 | 7/2013 |
| JP | 2000-185736 | 7/2000 |
| JP | 2013-180817 | 9/2013 |
| RU | 2495805 | 10/2013 |
| WO | WO 2009/090171 | 7/2009 |
| WO | WO 2013/172783 | 11/2013 |
| WO | WO 2014/031926 | 2/2014 |
| WO | WO 2014/150180 | 9/2014 |
| WO | WO 2014/165209 | 10/2014 |

OTHER PUBLICATIONS

Official Action for Australia Patent Application No. 2017273675, dated Apr. 29, 2020 7 pages.
Official Action for Canada Patent Application No. 3,025,959, dated Jan. 8, 2020 4 pages.
Decision to Grant for European Patent Application No. 17726231.8, dated Jan. 30, 2020 5 pages.
Official Action for European Patent Application No. 17724028.0, dated Sep. 10, 2019 8 pages.
Official Action for Australia Patent Application No. 2017273675, dated Aug. 30, 2019 6 pages.
Official Action for Canada Patent Application No. 3,025,959, dated Nov. 12, 2019 3 pages.
Official Action with English Translation for China Patent Application No. 201780041108.7, dated Oct. 23, 2019 26 pages.
Decision of Grant for Russia Patent Application No. 2018146412/12, dated Sep. 30, 2019 14 pages.
U.S. Appl. No. 16/303,855, filed Nov. 21, 2018, Hundeloh et al., filed Nov. 21, 2018.
International Search Report and Written Opinion for International (PCT) Patent Application No. PCT/EP2017/061816, dated Jul. 27, 2017 15 pages.
Third Party Observation for International (PCT) Patent Application No. PCT/EP2017/061816, dated Sep. 21, 2018 3 pages.
Third Party Observation for International (PCT) Patent Application No. PCT/EP2017/061863, dated Sep. 29, 2018 1 page.
Intention to Grant for European Patent Application No. 17724028.0, dated Nov. 5, 2020 34 pages.
Notice of Acceptance for Australia Patent Application No. 2017273675, dated Aug. 31, 2020 4 pages.
Notice of Allowance for Canada Patent Application No. 3,025,959, dated Nov. 10, 2020 1 page.
Notice of Allowance with English Translation for China Patent Application No. 20178004108.7, dated Jul. 27, 2020 5 pages.
Second Intention to Grant for European Patent Application No. 17726231.8, dated Jun. 19, 2020 5 pages.
Intention to Grant for European Patent Application No. 17726231.8, dated Nov. 26, 2020 38 pages.
Official Action for U.S. Appl. No. 16/303,855, dated Jun. 25, 2020 8 pages Restriction Requirement.
Official Action for U.S. Appl. No. 16/303,855, dated Nov. 27, 2020 20 pages.
Official Action for U.S. Appl. No. 16/303,855, dated Jun. 10, 2021 22 pages.
Notice of Allowance for U.S. Appl. No. 16/303,855, dated Oct. 1, 2021 9 pages.

* cited by examiner

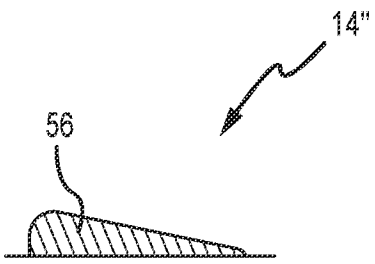
FIG.10B
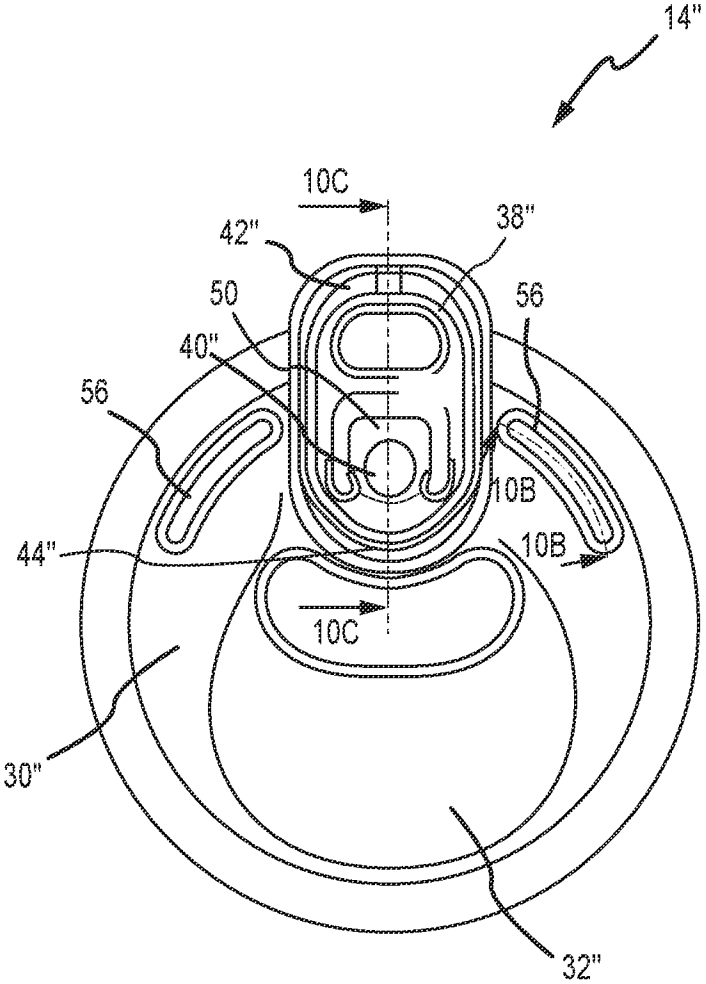
FIG.10A
FIG.10C
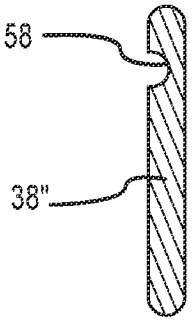

LID FOR AN ALUMINUM BEVERAGE CAN

CROSS REFERENCE TO RELATED APPLICATIONS

This application is a national stage application under 35 U.S.C. 371 of PCT Application No. PCT/EP2017/061863, having an international filing date of 17 May 2017, which designated the United States, which PCT application claimed the benefit of German Application Serial No. 10 2016 110 064.1, filed 31 May 2016, both of which are incorporated by reference in their entirety.

FIELD

The invention refers to can lids for two-piece aluminum beverage cans.

The invention refers to two-piece aluminum beverage cans with a unitary drawn and wall ironed (DWI) can body and a can lid with a pull tab.

BACKGROUND

Two-piece beverage cans comprise a can body made from one piece of aluminum sheet metal and a can lid with a pull tab affixed to the can lid. A score line in a panel of the can lid defines a tear panel that can be opened by means of the pull tab. The pull tab can be a stay-on-tab that opens a hinged tear panel. In prior art cans, the pull tab is affixed to the can end by a rivet that is formed from the sheet metal of the can lid. Can lids are also known as can ends.

The can body is a DWI can body that is produced by first drawing an aluminum blank into a cup and then ironing the walls of the cup to form the can body. The can body has an open end with a reduced diameter. The reduced diameter of the can body's open end is achieved by necking the can body in a necking machine in which the diameter of the open end is reduced in several stages.

Prior art cans often have a body that is cylindrical along the largest portion of its longitudinal extension. A typical diameter of prior art aluminum beverage cans is 66 mm. These cans are named 211 cans in the industry.

After filling a can body, e.g. with a carbonated beverage, a respective can lid is attached to the can body by way of a folded double seam. The can lid has a smaller diameter than the can body.

To match a respective can lid, the can body's diameter at the open end is reduced from 66 mm to the fitting diameter for the can lid, e.g. about 57 mm (206), 55 mm (204), 52 mm (202) or 50 mm (200), by way of necking.

A typical can body has a base and a cylindrical side wall that extends upwardly from the base and has a wall thickness in the order of 94 to 97 μm for a can having a diameter of 66 mm. A can having a diameter of 58 mm typically has a wall thickness in the order of 90 to 94 μm. The can body further has a tapered neck that extends upwardly from the cylindrical side wall and that defines the reduced diameter open end of the can body prior to seaming. The can body's open end has a smallest internal diameter called plug diameter, which approximately matches the metrical dimension of the can lid, e.g. 52 mm.

The ratio between the can's maximum diameter and the plug diameter that is achieved by way of necking is called necking ratio. The base includes a stand ring and a dome arranged within the stand ring.

The can lid is made from sheet metal aluminum and has a central panel wherein the rivet and the tear panel are arranged. The central panel is circumferentially surrounded by a countersink that in turn is circumferentially surrounded by an upwardly extending leg, e.g. a chuck wall. At the outer end of the upwardly extending leg, a curl is arranged that eventually is folded to form the seam that connects the can body and the can lid and that defines the lid's outside diameter. The can lid's chuck wall defines a plug diameter of the can lid.

On the central panel, a rivet for connecting a pull tab and a tear panel defined by a score line are arranged. The tear panel can be opened by means of the pull tab that breaks the score line when a handle part of the pull tab is lifted and thus an opening part of the pull tab is pressed on the tear panel next to the score line. Between the handle part and the opening part of the pull tab, a rivet island is arranged that is connected to the central panel by means of the rivet and that serves as a bending hinge for the pull tab.

It is an object of the invention to provide a can lid for an improved two-piece aluminum beverage can.

SUMMARY

According to the invention, this object is achieved by a can lid for an aluminum beverage can, said can lid comprising a pull tab, said can lid having a chuck wall defining a plug diameter, a countersink and a central panel having a panel radius. On the central panel, a score line defining a tear panel and a rivet for connecting a pull tab to the can lid are arranged. The lid has a lid plug diameter of between 45 to 49 mm, an outside diameter of between 52 to 55 mm, and a weight of less than 1.9 g. The central panel has a thickness of less than 0.19 mm. The rivet is arranged off-center on the central panel. The rivet is to tilted so that the rivet provides an axis of rotation of the pull tab that has an angle of between 1° and 6° with respect to an axis that is vertical with respect to the central panel or at least one ramp-up bead is arranged on either side of pull tab or on both sides of the pull tab. Thus, the rivet is tilted with respect a normal to a plane defined by countersink and the axis of rotation defined by the rivet is tilted with respect to a normal of a plane defined by the countersink. The tilt of the rivet facilitates lifting of a handle part of the pull tab if the pull tab is rotated about the rivet.

Alternatively, both, the rivet is tilted and at least one ramp-up bead is arranged on either side of pull tab or on both sides of pull tab.

Preferably, the pull tab can be swiveled between an initial shelf position wherein the opening part of the pull tab faces away from the tear panel and an opening position. In the opening position, the opening part of the pull tab is arranged to touch the tear panel when the handle part is lifted.

When the rivet is arranged off center with respect to the central panel, the finger access space for opening the easy opening end can become too small. This problem can be solved by a rotation tab. Initially, in factory finished position, when a beverage can is stored on a shelf, the handle part of the tab is positioned in-line or partly rotated to the center line of the tear panel. Rotation of the tab will now be required in either direction to get the tab in the opening position, like for standard can ends. Accordingly, the pull tab is initially not in the opening position allowing opening of the tear panel and, therefore, first must be rotated from the initial shelf position to the opening position prior to opening the tear panel. Rotation of the pull tab about the tilted rivet not only results in an alignment of the pull tab with the tear panel but also results in a lifted handle part of the pull tab that thus can be gripped more easily. In addition to a tilt of the rivet or as an alternative, at least one ramp-up bead can be provided that is arranged on either side or on both sides of the pull tab. Such ramp can also cause or support a lifting of the handle part if the pull tab is rotated about the axis of the rivet. Preferably, the ramp-up bead is arranged on the central panel.

To accommodate this action, and to improve finger access, two different approaches are provided:

Two ramp-up beads are arranged on both sides of the tab to accommodate bridging the tab over the chime and elevating the edge to an easy finger access level. Optionally a tab-positioning bead underneath the tab is incorporated in the central panel or on the tab's side facing the central panel or both, which accommodates finding the accurate opening position at the end of the rotation.

Alternatively or additionally, a tilted rivet island is provided, which elevates the tab during rotation to accommodate bridging the chime and to improve finger access. Again, optionally a tab positioning bead can be provided, which accommodates finding the accurate opening position at the end of the rotation.

One or more orientation beads can be provided that are configured and arranged to align the initially rotated pull tab into the opening position suitable for opening the tear panel. For instance, such orientation bead can be configured to provide a click-in effect when the pull tab is rotated about the rivet and eventually reaches its aligned orientation. The click-in effect provides tactile feedback and can be achieved by means of a gap or a recess in the orientation bead that receives a part of the pull tab, for instance a protrusion of the pull tab facing the central panel, when the pull tab is aligned with the tear panel.

Additionally or alternatively, the pull tab may have a gap or a recess on the side facing the central panel. This gap or recess may engage with the double seam that connects the can lid with the can body when the pull tab is aligned in its opening position, thus providing tactile feedback to the user indicating that the pull tab is in the opening position.

Accordingly, in a preferred embodiment, the central panel comprises at least one tab positioning notch or recess that is arranged to provide a tactile feedback if the tab is swiveled into its opening position suitable for opening the tear panel. The tab positioning recess is provided on the side of the tab facing the central panel, the recess being arranged to engage with the seam connecting the can lid to the can body when the can lid is applied to a can body.

The off-set of the axis of rotation of the rivet and the center of the central panel is preferably between 3 and 15 mm and even more preferably between 4 and 8 mm, e.g. 4.5 mm. This allows for a large enough opening even in a central panel having a smaller diameter than previous central panels.

Preferably, the axis of rotation of the pull tap that has an angle of between 2° and 4° with respect to an axis vertical to the central panel. This provides for enough of a lift of the handle part of the pull tab when the pull tab is rotated into its opening position to pass the chime.

Preferably, two ramp-up beads are arranged on the central panel, one ramp-up bead on each side of the pull tab. Thus, a user can rotate the pull tab in both directions from the initial shelf position to the opening position, while either ramp-up bead will help to lift the handle part of the pull tab to pass the chime that is provided by the seam connecting the can lid to the can body after the can lid is applied to the can body.

Preferably, the central panel has a diameter of between 36 mm and 40 mm and is thus smaller than previous central panels. This allows for a smaller overall size of the can lid that in turn allows for lighter can lids and can bodies compared to previous cans having the same contents volume.

Preferably, the can end is made from aluminum or steel sheet metal, that may be precoated or plain.

Preferably, an absorption bead is arranged next to the tear panel.

BRIEF DESCRIPTION OF THE DRAWINGS

The above and other aspects, features and advantages of the present invention will be more apparent from the following more particular description thereof presented in conjunction with the following drawings, wherein:

FIG. 10A is a top-level view of the third embodiment of a can lid according to FIG. 9 with the tab in its opening position;

FIG. 10B is a cross-sectional view of a portion of the pull tab and the ramp up bead of FIG. 10A taken along line 10B-10B;

FIG. 10C is a cross-sectional view of the pull tab of FIG. 10A taken along line 10C-10C;

DETAILED DESCRIPTION

The following description is of the best mode presently contemplated for carrying out the invention. This description is not to be taken in a limiting sense but is made merely for the purpose of describing the general principles of the invention. The scope of the invention should be determined with reference to the claims.

Figure 1:
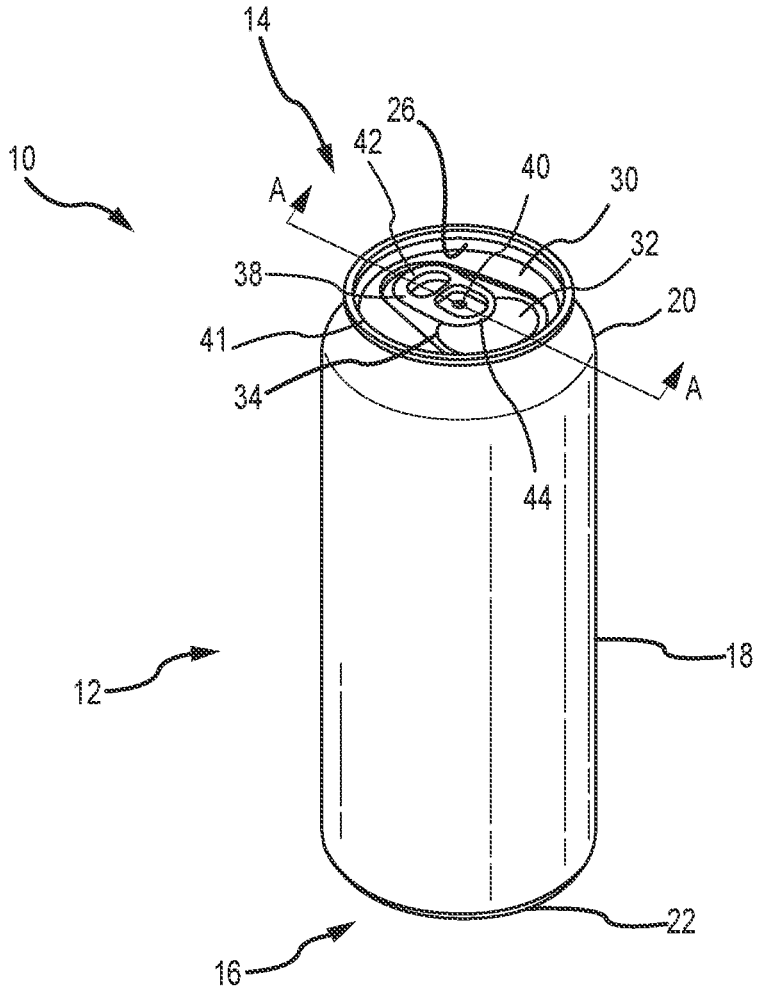
FIG. 1 is a side-elevated perspective view of a seamed two-piece beverage can according to the invention.

FIG. 1 shows a two-piece aluminum beverage can 10 according to the invention. The can comprises a can body 12 and a can lid 14 seamed to the can body. The can body 12 is a unitary DWI can body and the can lid 14 has a pull tab 38.

The can body 12 is formed from a single piece of aluminum sheet metal (blank) and has a base 16, a cylindrical sidewall 18 and a neck 20. The base 16 has a stand ring 22 and a dome 24. The can body 12 is preferably made from aluminum, in particular from series 3000 aluminum.

The can lid 14 has a chuck wall 26, a countersink 28 and a central panel 30. In the central panel, a tear panel 32 is provided, which is defined by a score line 34. Next to the tear panel, a material absorption bead may be arranged. Pull tab 38 is affixed to the central panel 30 by means of a rivet 40. A central section of the pull tab 38 is a rivet island 50 that is fixated to the central panel 30 by means of the rivet 40. Typically, the pull tab 38 can be rotated about the rivet 40 if a certain force is applied. The axis of rotation is perpendicular with respect to a plane defined by the rivet island 50. The pull tab 38 has a handle part 42 to be gripped by a user's finger and an opening part 44 that is pressed against the tear panel 32 if the handle part 42 is lifted by a user. Thus, the pull tab 38 serves to rupture the score line 34 in order to open the beverage can 10 in a known manner. The tear panel 32 thus defines the dimensions of the opening created by lifting the handle part of the pull tab 38. The tear panel defines an opening—for instance a drinking opening—having an area of between 300 $mm^2$ to 350 $mm^2$ after opening the beverage can.

The can lid 14 is fixed to the can body 12 by means of a folded double seam 41. The seam 41 has a diameter of between 46 mm and 49 mm.

The diameter L of the seam 41 (illustrated in FIG. 2) is approximately 48 mm. The diameter J of the stand ring 22 (illustrated in FIG. 3) is smaller than the diameter L of the seam 41. Therefore, beverage cans can be stacked upon one another, so that the stand ring of the upper can protrudes into the space within the seam 41. Alternatively, the stand ring may have a larger diameter than the seam.

The can body 12 has a can body plug diameter of between 45 to 49 mm and a weight below 9.3 g for a 330 ml can, and below 9.7 g for a 355 ml can.

The can lid 14 has a can plug fitting diameter of between 45 to 49 mm, an outside diameter of between 52 to 55 mm, a central panel with a thickness of less than 0.19 mm, e.g. 0.183 mm, and a weight of less than 1.9 g.

Figure 2:
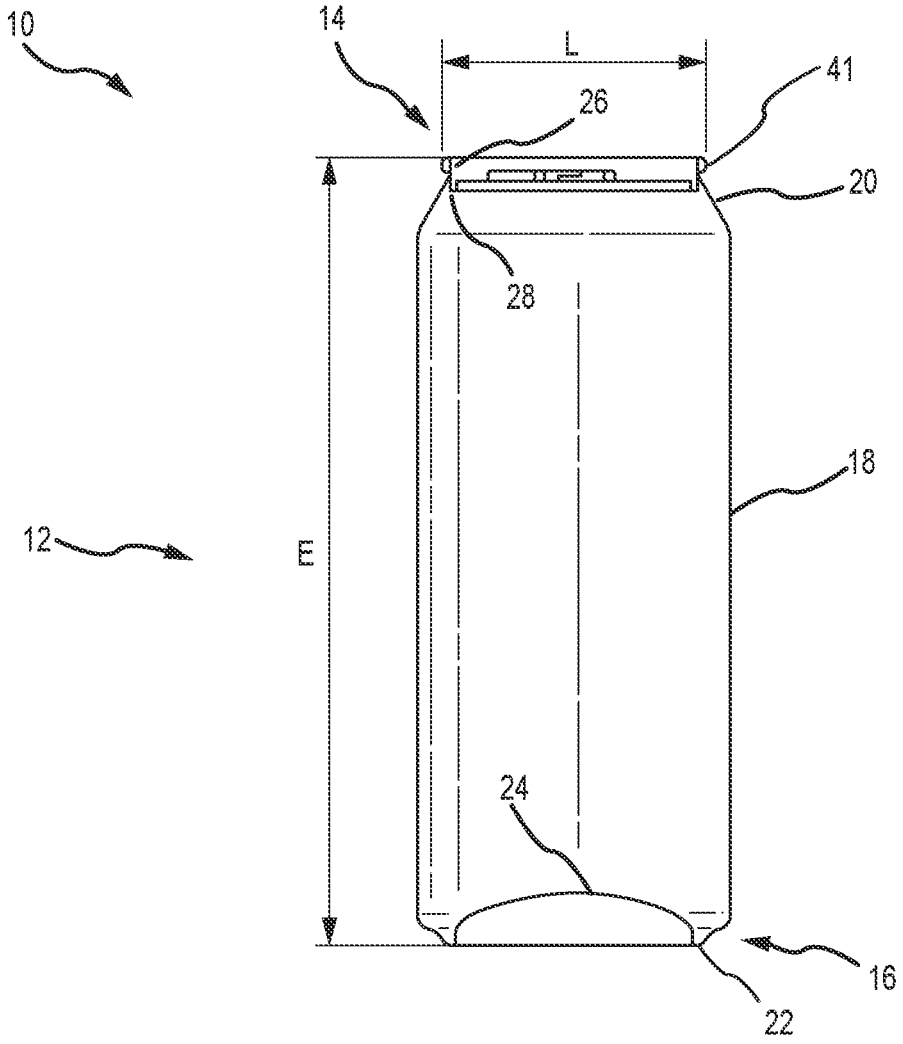
FIG. 2 is a cross-sectional view of a seamed two-piece beverage can taken along line A-A in FIG. 1.

FIG. 2 is a cross-sectional view of the can 10 with the can lid 14 seamed to the can body 12. In the cross-sectional view, the chuck wall 26 and the countersink 28 of the can lid 14 can be seen as well as the cylindrical side wall 18, the neck 20, the stand ring 22 and the dome 24 of the can body 12.

Figure 3:
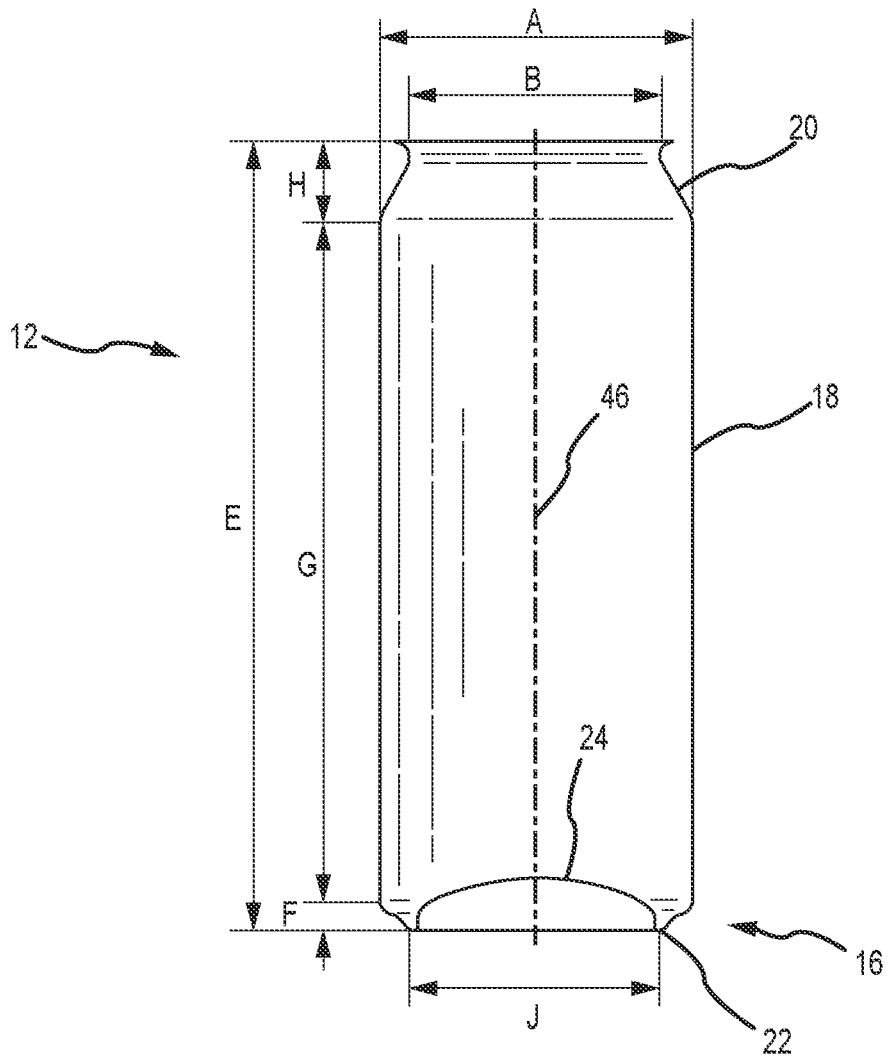
FIG. 3 is a cross-sectional view of the can body in FIG. 2 prior to seaming.

Referring to FIG. 3, the diameter A of the can is between 56 mm and 59 mm, for instance approximately 58 mm. The can diameter A corresponds to the diameter of the cylindrical side wall 18. As can be seen from FIG. 3, the base 16 extends along a height F of about 5 to 10 mm. The cylindrical side wall 18 has a height G of about 120 mm. The neck 20 has a height H of about 17 mm. The can body 12 is symmetric about a longitudinal axis 46. Prior to sealing, the can body 12 has an upper open end with an inner diameter B, which is called the plug diameter, which is about 46 mm.

The can body 12 is produced by a DWI process wherein first a cup is formed and then the side wall is formed by drawing and wall ironing. Thereafter, the neck 20 is formed in a necking machine (necker) to achieve an upper can end that has a smaller diameter than the maximum can diameter. The ratio of the plug diameter B to the can diameter A (B/A) is called the necking ratio. The necking ratio of the can body 12 of the embodiment of FIG. 3 is a little less than 80%.

The can body 12 is drawn from a single piece of aluminum sheet metal, having a gauge of 242 μm. Therefore, the wall thickness in the middle of the dome 24 is approximately 240 μm.

The maximum wall thickness of the can in the middle of the dome 24 of the base 16 is between 235 μm and 245 μm, such as 240 μm or 242 μm. The tool for drawing and wall ironing is preferably configured to create a transitional wall thickness from the base to the side wall in two steps. The tool preferably provides a first step with an angle of 1° and a second step with an angle of an angle of about 30'. Thus, the wall thickness of the can body is reduced from about 240 μm in the area of the base to about 79 μm at the middle part of the side wall 18.

The wall thickness of the middle part of the neck is about 111 μm. The neck has a flange at its upper end having a wall thickness in the range of between 130 μm and 150 μm, for instance 140 μm.

The transition from the side wall 18 to the neck 20 is rounded. The radius in the transition from the side wall 18 to the neck 20 is between 10 mm and 20 mm, for instance 15 mm. Such a transition is also called a "round shoulder".

The angle of the neck 20 relative to the side wall 18 of the can body 12 is between 25° and 35°, for instance 30°.

The beverage can 10 has a nominal volume of between 330 ml and 355 ml and a height E of approximately of between 145 mm and 147 mm for a 330 ml can and a height E of between 156 mm and 159 mm for a 355 ml can.

A can body according to the embodiments of the Figures has a weight below 9.3 g for a can with a nominal volume of 330 ml and below 9.7 g for a can having a nominal volume of 355 ml.

The total internal volume of the seamed can is the nominal volume plus a head space. The volume of the head space is less than 20 ml, for instance 18 ml. Thus, a can with a nominal volume of 330 ml has a total internal volume of 348 ml, and a can with a nominal volume of 355 ml has a total internal volume of 373 ml.

Figure 4:
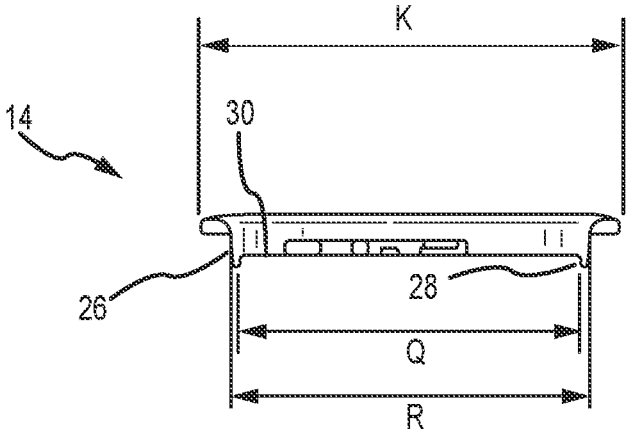
FIG. 4 is a cross-sectional view of the can lid in FIG. 2 prior to seaming.

FIG. 4 is a cross-sectional view of the can lid 14 prior to seaming, illustrating the outside diameter (curl diameter) K. FIG. 4 further illustrates a can lid plug diameter R that is defined by the chuck wall 26 and a central panel diameter Q of the central panel 30.

Figure 5:
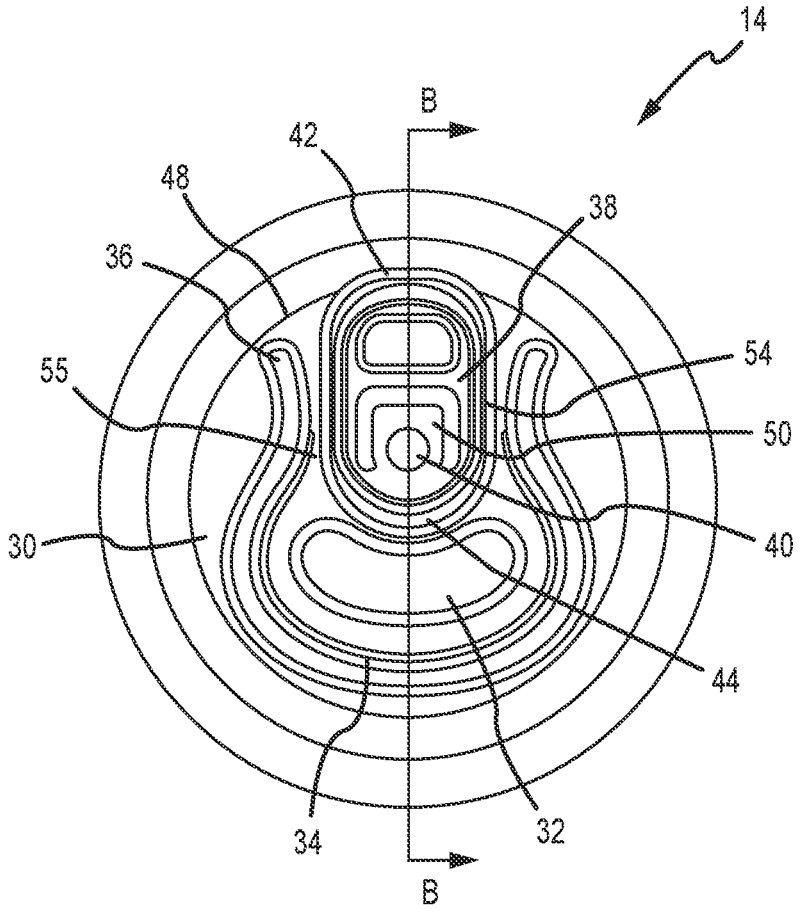
FIG. 5 is a top plan view of a first embodiment of a can lid according to the invention with the tab in its opening position.

FIG. 5 is a top plan view of a first embodiment of a can lid according to the invention. The can lid 14, as illustrated in FIG. 5, has a can lid plug diameter R of 45.4 mm, and a central panel diameter Q of 37.55 mm. As can be taken from FIG. 5, on a central panel 30, an off center rivet 40 is arranged that connects a rivet island 50 of the pull tab 38 to the central panel 30. The rivet island 50 is an integral part of the pull tab 38 and forms a bendable hinge between the handle part 42 of the pull tab 38 and an opening part 44 of the pull tab 38. An outer curl 54 of the pull tab 38 provides for sufficient stiffness between the handle part 42 and the opening part 44, so that the opening part 44 can exert a strong enough force on the tear panel 32 when the handle part 42 of the pull tab 38 is lifted.

The tear panel 32 is defined by a score line 34 and has an area of 331 $mm^2$ and has a shark fin design featuring a triangular extension 55 next to the rivet that improves pouring because it allows air into the can. The can lid 14 is made from pre-coated aluminum sheet metal.

Figure 6:
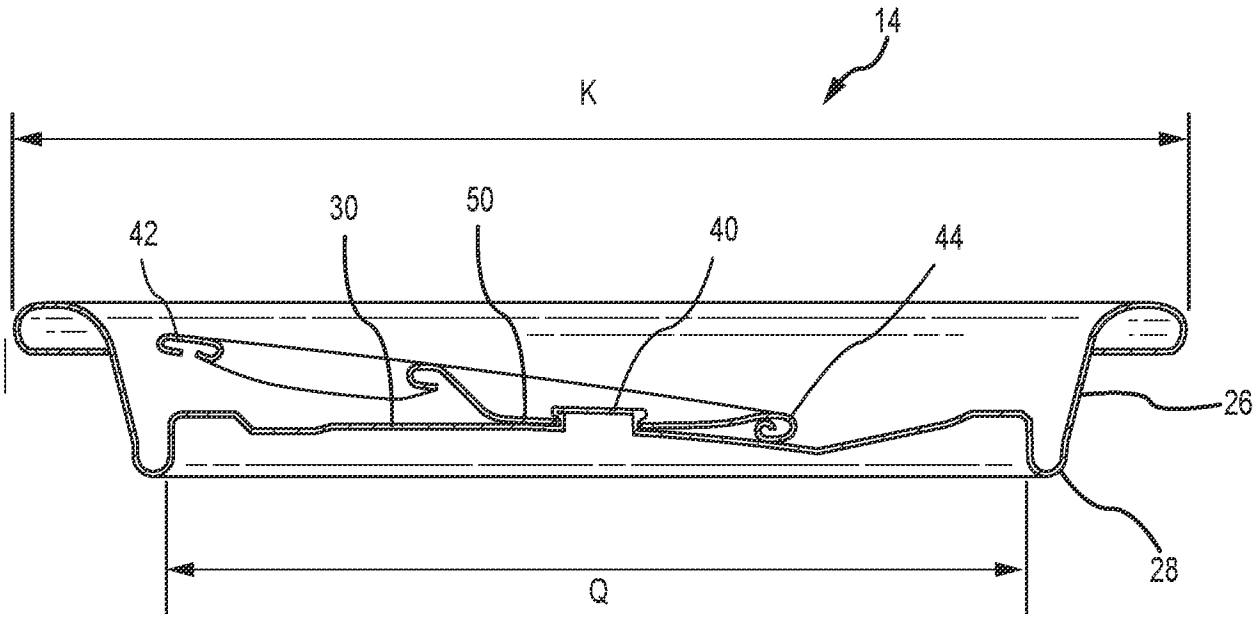
FIG. 6 is a cross-sectional view of an alternative can lid prior to seaming taken along line B-B in FIG. 5.

In order to improve the accessibility of the handle part 42 of the pull tab 38, the rivet 40 may be tilted, as shown in FIG. 6. The axis of rotation defined by the rivet 40 is tilted with respect to a normal to a plane defined by the countersink 28. Likewise, the plane defined by the rivet island 50 has a tilt angle with respect to the plane defined by the countersink 28. The tilt angle is between 2° and 4°, for instance 3°. A tilted rivet as shown in FIG. 6 is particularly useful with an embodiment as shown in FIG. 5. However, a tilted rivet can also be provided with an embodiment as shown in FIGS. 7 and 8A-8B or 9 and 10A-10C.

In the embodiment of FIG. 5, the pull tab 38 is already orientated in its opening position where the opening part 44 of the pull tab 38 is placed above the tear panel 32. Therefore, lifting the handle part 42 of the pull tab 38 causes the opening part 44 to impart a force on the tear panel 32 leading to a rupture of the score line 34.

Alternatively, the can lid can have a pull tab that initially is oriented in the initial shelf position with respect to the tear panel. In such embodiment, the pull tab first must be aligned with the tear panel in order to allow for opening of the tear panel. Aligning the pull tab requires the pull tab to be rotated such that the handle part of the pull tab can be gripped easier.

Figure 8B:
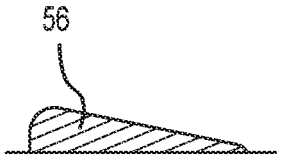
FIG. 8B is a cross-sectional view of the pull tab and the ramp up bead of FIG. 8A taken along line 8B-8B.
Figure 8A:
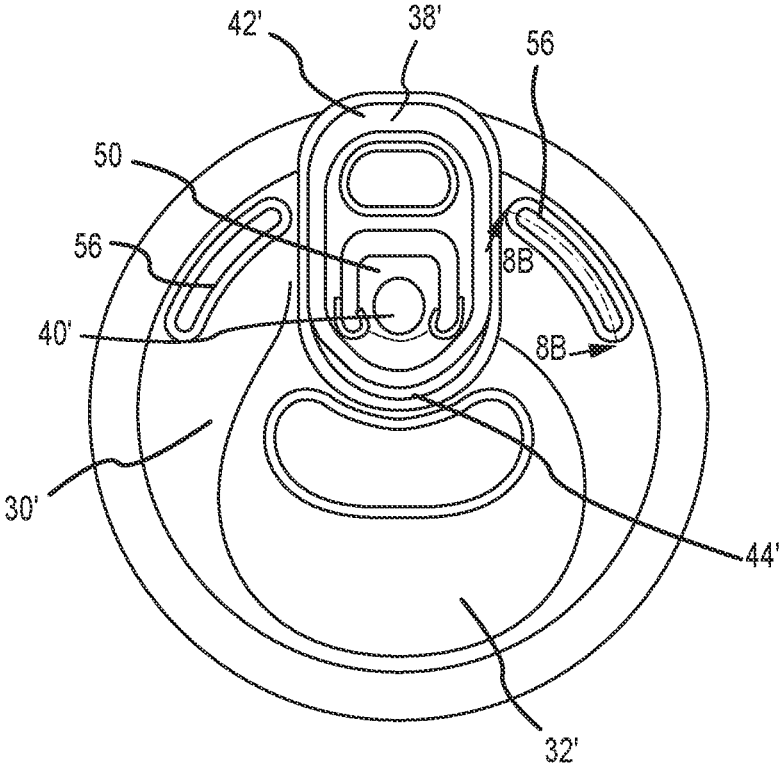
FIG. 8A is a top-level view of the second embodiment of a can lid according to FIG. 7 with the tab in its opening position.
Figure 9:
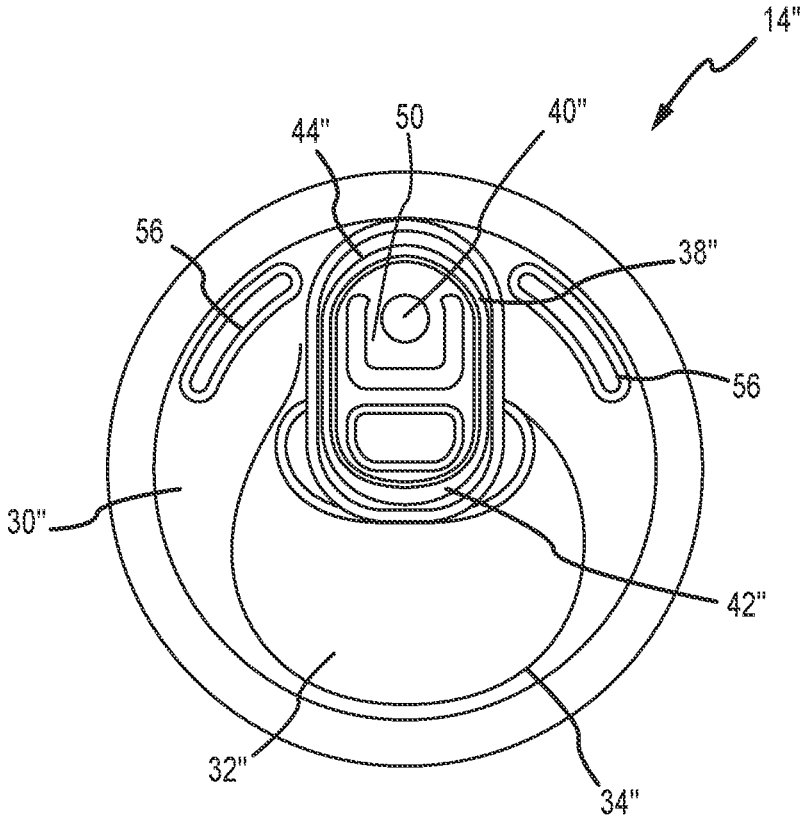
FIG. 9 is a top-level view of a third alternative embodiment of a can lid according to the invention with the tab in its initial shelf position.

Lifting and aligning the handle part of the pull tab can be facilitated by ramp-up beads 56 arranged on either side of the pull tab 38; see FIG. 9. Ramp-up beads assist in lifting the pull tab when the pull tab is rotated about an axis of rotation defined by the rivet; see the embodiments depicted in FIGS. 7 to 10C.

Figure 7:
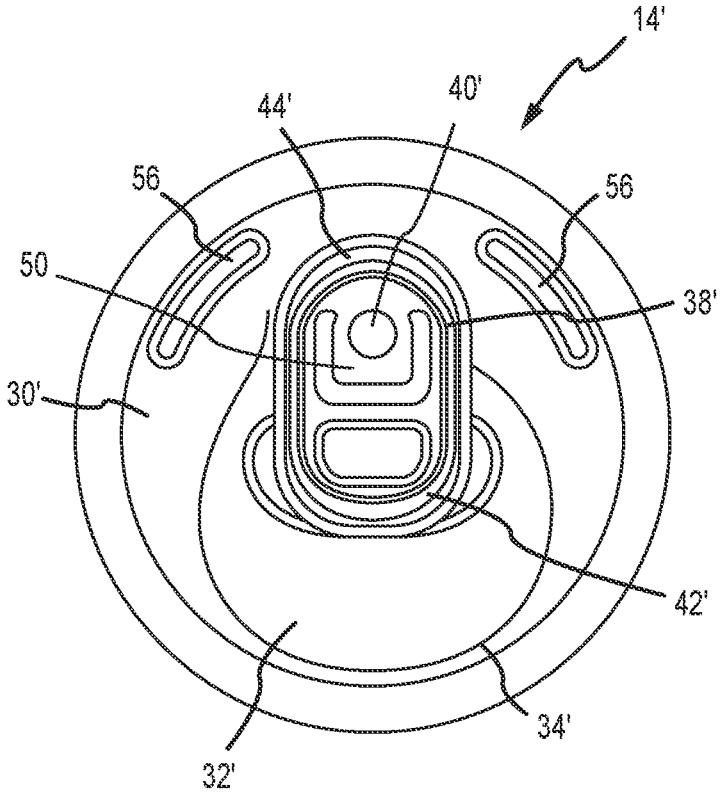
FIG. 7 is a top-level view of a second alternative embodiment of a can lid according to the invention with the tab in its initial shelf position.

FIG. 7 is a top-level view of a second, alternative embodiment of the can lid 14'. FIG. 7 depicts the pull tab 38' orientated in an initial shelf position that is suitable for stacking cans, for instance when stored in on shelf. FIG. 8A depicts the same can lid with the pull tab 38' in its opening position. As can be taken from FIGS. 7 and 8A-8B, the pull tab 38' must be rotated by about 180° in order to swivel the pull tab 38' from the initial shelf position to the opening position. Swiveling occurs around the axis of rotation defined by the rivet 40'. When the pull tab 38' is in its opening position, the handle part 42' extends beyond the outer diameter of the central panel 30'. Accordingly, the handle part 42' must be lifted in order to move the handle part 42' over the chime formed by the double seam 41 when the can lid 14' is applied to a can body such as the can body 12 (see FIGS. 1 and 2).

In order to facilitate lifting of the handle part 42' of the pull tab 38' during rotation, two ramp-up beads 56 are provided. The wedge-like shape of the ramp-up beads 56 (as generally illustrated in FIG. 8B) causes lifting of the handle part 42' when the handle part 42' slides along the ramp-up bead 56 when rotated. The lifting of the handle part 42' and the extension of the handle part 42' over the outer periphery of the central panel 30' facilitates gripping of the handle part 42' with the finger of a user when opening the can lid 14'.

Additionally, a gap is provided between the most elevated parts of the ramp-up beads 56. The gap between the two ramp-up beads 56 has a width that approximately corresponds to the width of the pull tab 38'. This has the effect, that the pull tab 38' will slightly lock in the gap between the ramp-up beads 56 and thus provides a tactile feedback when pull tab 38' has arrived in its opening position. This further facilitates handling of the can lid 14' by a user.

Aligning the pull tab 38' is assisted by a tab positioning notch or recess 58 that is arranged to provide a tactile feedback if the tab 38' is swiveled into its opening position suitable for opening the tear panel. The tab positioning recess 58 (shown in FIG. 10C) is provided on the tab's side facing the central panel 30', the recess being arranged to engage with the seam 41 connecting the can lid 14' to the can body 12 when the can lid 14' is applied to a can body 12. When tab 38' is swiveled into its opening position, the positioning recess 58 engages with the seam 41 as shown in FIG. 11.

FIGS. 9 to 10C show an embodiment of a can lid 14" similar to the embodiment of FIGS. 7 and 8A-8B differing only in details and dimensions. The pull tab 38" of the embodiment of FIG. 10A has a gap or a recess 58 on the pull tab's side facing the central panel. This gap or recess 58 may engage with the double seam 41 that connects the can lid 14" with the can body 12 when the pull tab 38" is aligned in its opening position, thus providing tactile feedback to the user indicating that the pull tab is positioned for opening the can.

Figure 11:
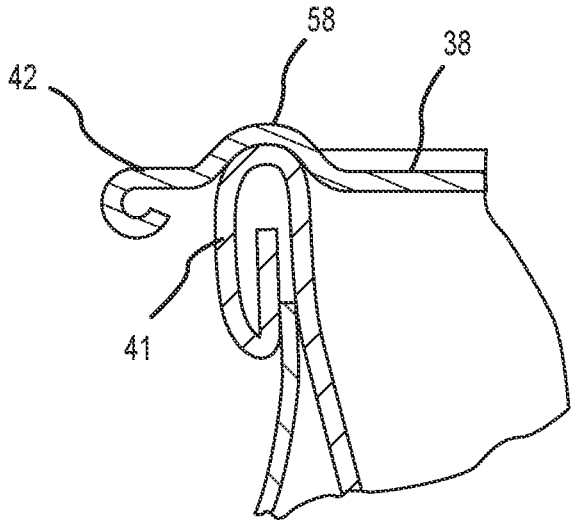
FIG. 11 shows details of an orientation notch on the lower side of the handle part of the pull tab that helps align the pull tab in its opening position.
Figure 12B:
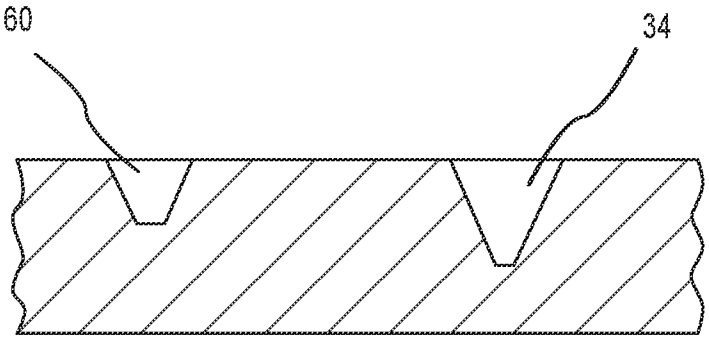
FIG. 12B is a cross-sectional view of the score line in FIG. 12A taken along line 12B-12B.
Figure 12A:
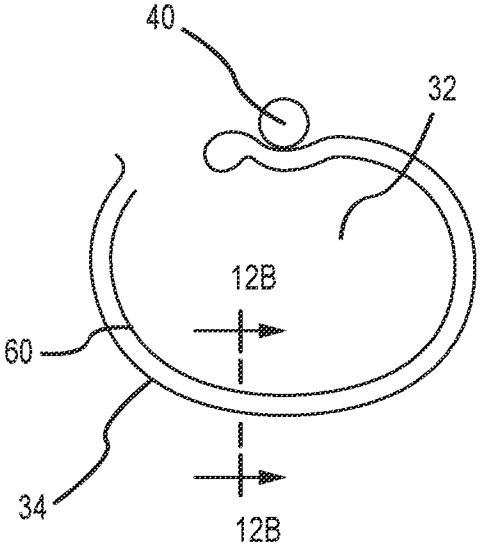
FIG. 12A shows details of a first variant of the score line.

FIG. 11 shows details of the positioning recess 58 on the lower side of the handle part 42 of the pull tab 38 that helps to align the pull tab in its opening position.

FIGS. 12A and 12B and FIGS. 13A and 13B show cross-sections of alternative embodiments of the score line 34 or 34', respectively. In the embodiment shown in FIGS. 12A and 12B, an anti fracture score 60 is provided that runs in parallel to the score line 34. The anti fracture score 60 has the effect to lower the tensile stress near the deepest portion of the score line 34 and thus avoids an unwanted fracture of the score line prior to intended opening of the tear panel 32.

Figure 13B:
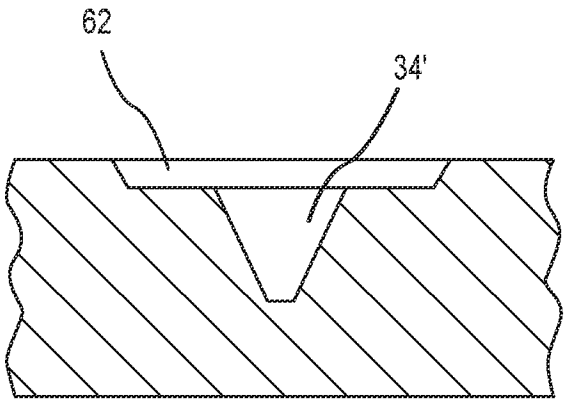
FIG. 13B is a cross-sectional view of the score line in FIG. 13A taken along line 13B-13B.
Figure 13A:
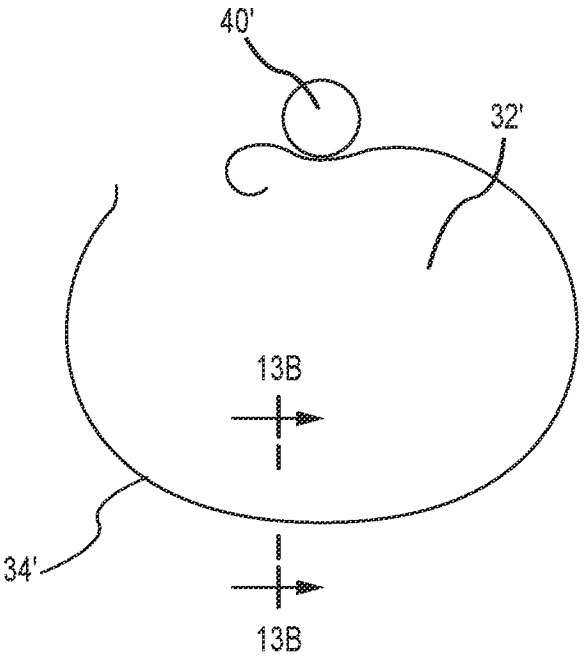
FIG. 13A shows details of a second variant of the score line.

In the alternative embodiment shown in FIGS. 13A and 13B, a background penetration 62 is provided that runs along the score line 34'. Similar to the anti fracture score 60 of FIGS. 12A and 12B, the background penetration 62 has the effect to lower the tensile stress near the deepest portion of the score line 34' and thus avoids an unwanted fracture of the score line prior to the intended opening of tear panel 32'.

LIST OF REFERENCE NUMERALS

10 Can
12 Can body
14, 14', 14" Can lid
16 Base
18 Side wall
20 Neck
22 Stand ring
24 Dome
26 Chuck wall
28 Countersink
30, 30', 30" Central panel
32, 32' Tear panel
34, 34', 34" Score line
36 Absorption bead
38, 38', 38" Pull Tab
40, 40', 40" Rivet
41 Double Seam
42, 42', 42" Handle part
44, 44', 44" Opening part
46 Longitudinal axis of can body
48 Panel radius
50 Rivet island
54 Outer curl
55 Triangular extension (shark fin)
56 Ramp-up bead
58 Recess
60 Anti fracture score
62 Background penetration
A Maximum diameter
B Plug diameter (or Inner diameter)
B/A Necking Ratio E Can height
F Base height
G Cylindrical sidewall height
H Neck height
J Stand ring diameter
K Curl diameter
L Seam diameter
Q Central panel diameter
R Can lid plug diameter

What is claimed is:

1. A can lid for an aluminum beverage can, comprising:
a peripheral curl adapted to interconnect the can lid to a neck of a beverage can, the peripheral curl having a diameter of no greater than approximately 55 mm;
a chuck wall interconnected to the peripheral curl and extending downwardly;
a countersink interconnected to a lower portion of the chuck wall;
a central panel interconnected to the countersink, the central panel having a center, a panel radius that defines a panel area, and a score line that defines a tear panel with an area of between approximately 24% and approximately 34% of the panel area of the central panel;
a rivet which is positioned off-center on the central panel, the rivet being tilted at an angle of between 1° and 6° with respect to a line normal to the central panel;
a pull tab connected to the central panel by the rivet, the pull tab having a handle part and an opening part, wherein the pull tab can be swiveled around an axis of rotation defined by the rivet such that the handle part of the pull tab extends outwardly beyond the panel radius, wherein the rivet is tilted such that the opening part of the pull tab is tilted towards the tear panel when the pull tab is in an opening position, and wherein the handle part of the pull tab extends outwardly beyond the panel radius and the opening part of the pull tab is arranged to touch the tear panel when the handle part is lifted; and
a ramp-up bead arranged on at least one side of the pull tab.

2. The can lid according to claim 1, wherein when the pull tab is in an initial position the handle part of the pull tab is positioned within the panel radius.

3. The can lid according to claim 2, wherein the handle part of the pull tab comprises an orientation notch that is configured to engage with a seam when the pull tab is swiveled to its opening position, the seam formed when the can lid is connected to the neck of the beverage can.

4. The can lid according to claim 1, wherein the axis of rotation defined by the rivet is off-set from the center of the central panel by between approximately 3 mm and approximately 15 mm.

5. The can lid according to claim 4, wherein the axis of rotation defined by the rivet is off-set from the center of the central panel by between approximately 4 mm and approximately 8 mm.

6. The can lid according to claim 1, wherein two ramp-up beads are arranged on the central panel, one ramp-up bead on each side of the pull tab.

7. The can lid according to claim 6, wherein a gap is defined between the two ramp-up beads, and wherein the gap has a width that is greater than a width of the pull tab to provide a tactile feedback to the user when the pull tab is swiveled and reaches the opening position suitable for opening the tear panel.

8. The can lid according to claim 1, further comprising a background penetration formed in the central panel that is configured to lower a tensile strength of the score line, the background penetration positioned adjacent the score line on both sides and having a first width and a first depth, wherein the first width is greater than a widest portion of the score line and the first depth is less than a maximum depth of the score line.

9. The can lid according to claim 1, wherein the can lid is made from an aluminum or a steel sheet metal material.

10. A beverage can, comprising:
a body that is symmetric about a longitudinal axis and includes:
a base end with a stand ring and a dome, the stand ring defining a ring diameter;
a sidewall extending upwardly from the base end; and
a neck; and
a can lid interconnected to an upper end of the neck by a seam, the seam having a seam diameter of between 46 mm and 49 mm that is greater than the ring diameter such that the beverage can may be stacked upon a second beverage can, wherein before the can lid is interconnected to the neck, the can lid has a peripheral curl with a diameter of no greater than approximately 55 mm, and wherein the can lid comprises:
a chuck wall extending downwardly from the seam;
a countersink at a lower portion of the chuck wall; and
a central panel interconnected to an inner portion of the countersink, the central panel having a panel radius that defines a panel area, a diameter that is no greater than 40 mm, a score line defining a tear panel with an area of between approximately 24% and approximately 34% of the panel area of the central panel, a rivet with a center that is offset from the longitudinal axis of the body, the rivet being tilted toward the tear panel at an angle of between 1° and 6° with respect to a line normal to the central panel, and a pull tab interconnected to the central panel by the rivet, the pull tab having an opening end configured to apply a force to the tear panel when a grip end of the pull tab is lifted, and a ramp-up bead arranged on at least one side of the pull tab, wherein the pull tab is configured to rotate around the rivet from a stored position to an opening position, wherein the rivet is tilted such that the opening end of the pull tab is tilted towards the tear panel when the pull tab is rotated into the opening position, and wherein the pull tab has a length such that in the stored position the pull tab fits entirely within the central panel and in the opening position a portion of the opening end is positioned above the tear panel and the grip end is positioned at least partially beyond the panel radius.

11. The beverage can of claim 10, wherein the center of the rivet is offset from the longitudinal axis of the body by a distance of between approximately 3 mm and approximately 15 mm.

12. The can lid of claim 9, further comprising a recess formed in the handle part of the pull tab.

13. The can lid of claim 12, wherein the recess is formed between an end of the handle part and a rivet island that connects the pull tab to the rivet, the recess extending into a planar surface of the pull tab that faces the central panel.

14. The can lid of claim 13, wherein in the opening position, the end of the handle part extends beyond the peripheral curl.

15. The can lid of claim 1, wherein the ramp-up bead is curved and is configured to raise the handle part over the peripheral curl when the pull tab is rotated from an initial position to the opening position.

16. The can lid of claim 15, wherein the ramp-up bead is positioned proximate to the panel radius.

17. The can lid of claim 16, wherein the ramp-up bead has an arcuate length that is approximately concentrically aligned with an outer edge of the central panel.

18. A can lid for an aluminum beverage can, comprising:

a peripheral curl adapted to interconnect the can lid to a neck of a beverage can, the peripheral curl having a diameter of no greater than approximately 55 mm;

a chuck wall interconnected to the peripheral curl and extending downwardly;

a countersink interconnected to a lower portion of the chuck wall;

a central panel interconnected to the countersink, the central panel having a center, a panel radius that defines a panel area, and a score line that defines a tear panel with an area of between approximately 24% and approximately 34% of the panel area of the central panel;

a rivet which is positioned off-center on the central panel;

a pull tab connected to the central panel by the rivet, the pull tab having a handle part and an opening part, a recess formed in the handle part of the pull tab, the recess extending into a lower surface of the pull tab, wherein the pull tab can be swiveled around an axis of rotation defined by the rivet such that the handle part of the pull tab extends outwardly beyond the panel radius, the rivet being tilted at an angle of between 1° and 6° with respect to a line normal to the central panel such that the opening part of the pull tab is tilted towards the tear panel when the pull tab is in an opening position, and wherein the handle part of the pull tab extends outwardly beyond the panel radius and the opening part of the pull tab is arranged to touch the tear panel when the handle part is in the opening position; and a ramp-up bead arranged on at least one side of the pull tab.

19. The can lid of claim 18, wherein the recess is formed between an end of the handle part and a rivet island that connects the pull tab to the rivet, and wherein the lower surface of the pull tab is planar.

* * * * *